US009850048B2

(12) United States Patent
Burbank et al.

(10) Patent No.: US 9,850,048 B2
(45) Date of Patent: Dec. 26, 2017

(54) CONTAINER SEAL CUTTING DEVICE

(71) Applicants: Daniel P. Burbank, Moultonborough, NH (US); Brian W. Burbank, Denton, TX (US)

(72) Inventors: Daniel P. Burbank, Moultonborough, NH (US); Brian W. Burbank, Denton, TX (US)

( * ) Notice: Subject to any disclaimer, the term of this patent is extended or adjusted under 35 U.S.C. 154(b) by 95 days.

(21) Appl. No.: 14/992,227

(22) Filed: Jan. 11, 2016

(65) Prior Publication Data

US 2016/0251128 A1 Sep. 1, 2016

Related U.S. Application Data

(60) Provisional application No. 62/121,559, filed on Feb. 27, 2015.

(51) Int. Cl.

| | |
|---|---|
| ***B65D 17/52*** | (2006.01) |
| ***B65D 51/24*** | (2006.01) |
| ***B65D 41/04*** | (2006.01) |
| ***B65D 51/22*** | (2006.01) |

(52) U.S. Cl.

CPC ..... *B65D 51/243* (2013.01); *B65D 41/04* (2013.01); *B65D 51/223* (2013.01)

(58) Field of Classification Search

CPC .... B65D 51/24; B65D 51/243; B65D 51/223; B65D 41/04; B65D 51/18; B65D 51/185; B65D 51/20; B65D 51/22; B65D 51/221; B65D 51/222; B65D 51/2814; B65D 5/747; B65D 51/226; B65D 43/02; B65D 47/106; B65D 51/224; B65D 51/225; B65D 7/00; B65D 49/00

USPC ..... 220/260, 265, 266, 267, 277, 278, 284, 220/345.1; 215/250, 257, 253, 247, 249, 215/295, 297, 217, 226, 235, 243; 222/80, 81, 87, 83; 206/222

See application file for complete search history.

(56) References Cited

U.S. PATENT DOCUMENTS

| | | | | |
|---|---|---|---|---|
| 4,709,822 A * | 12/1987 | Vataru | B65D 50/046 215/216 |
| 4,770,305 A | 9/1988 | Su | |
| 4,993,569 A | 2/1991 | Osip et al. | |
| 5,090,582 A * | 2/1992 | Art | B65D 51/225 215/226 |

(Continued)

*Primary Examiner* — Kareen Thomas

(74) *Attorney, Agent, or Firm* — Global Intellectual Property Agency, LLC

(57) ABSTRACT

A container seal cutting device for removing the seal of a container. The container seal cutting device includes a cap having a top wall, one or more sidewalls, and an open lower end that can receive the mouth of a container therein. The upper surface of the top wall includes a cutting blade pivotally secured thereto. The cutting blade is movable between a stored configuration and an upright configuration. In the stored configuration, the cutting blade rests within a recessed area on the cap so that it remains substantially flush with the upper surface thereof. In the upright configuration, the cutting blade extends substantially perpendicular from the upper surface of the cap so it can be utilized to remove the seal of a container. The device further includes a protrusion disposed on the cutting blade in order to safely move the cutting blade between the stored and upright configuration.

8 Claims, 3 Drawing Sheets

(56) References Cited

U.S. PATENT DOCUMENTS

| | | | | |
|---|---|---|---|---|
| 5,709,311 | A * | 1/1998 | Butler | B65D 51/223 215/228 |
| 5,758,788 | A | 6/1998 | Lifshey | |
| 5,797,506 | A * | 8/1998 | Lehmkuhl | B65D 51/223 215/228 |
| 6,024,234 | A | 2/2000 | Rink et al. | |
| 6,039,198 | A | 3/2000 | Wolfe et al. | |
| 6,056,142 | A | 5/2000 | Elliott | |
| 6,182,845 | B1 | 2/2001 | Wolfe et al. | |
| 6,386,385 | B1 * | 5/2002 | Amanat | B67B 7/00 215/228 |
| 7,410,071 | B1 | 8/2008 | Seib et al. | |
| 2005/0252931 | A1 * | 11/2005 | Moulton | B65D 5/748 222/83 |
| 2012/0325769 | A1 | 12/2012 | Essebaggers et al. | |

* cited by examiner

CONTAINER SEAL CUTTING DEVICE

CROSS REFERENCE TO RELATED APPLICATION

This application claims the benefit of U.S. Provisional Application No. 62/121,559 filed on Feb. 27, 2015. The above identified patent application is herein incorporated by reference in its entirety to provide continuity of disclosure.

BACKGROUND OF THE INVENTION

Field of the Invention

The present invention relates to container seal cutting devices. More specifically, the present invention provides a container seal cutting device comprising a cap adapted to removably secure to the mouth of a container having a protective seal thereon. The cap includes a recessed area disposed on an upper surface thereof, wherein a cutting blade rests within the recessed area and is pivotally secured to the upper surface. The cutting blade is movable between a stored configuration and an upright configuration, wherein the cutting blade is adapted to puncture and cut the seal of the container while in the upright configuration so the seal can be removed therefrom.

Many products are packaged in bottles or other containers whose openings are sealed by a thin membrane of a suitable material, such as a metallic foil or a plastic film, until a consumer is ready to remove the contents from the container. The protective seals serve a myriad of functions, such as preventing the product from leaking out during shipment, preventing product contamination, preserving product freshness, and ensuring the consumer that the product has not been tampered. Unfortunately, when a consumer is ready to remove the contents of the container or bottle, a knife or other sharp object may not be readily available. Some individuals attempt to open such a seal with their hands. However, this technique is ineffective and risks contaminating and spilling the contents of the container on the user or elsewhere. Therefore, there exists a need in the prior art for a device that can be integrated with existing containers and bottles that allow the protective seals to be cut and easily removed therefrom.

Devices have been disclosed in the prior art that relate to container seal cutting devices. These include devices that have been patented and published in patent application publications. These devices generally relate to closures having a piercing tip extending therefrom, such as U.S. Pat. Nos. 6,024,234, 6,039,198, 7,410,071, 5,758,788, 6,056,142, 4,993,569, 4,770,305, U.S. Patent Application Publication Number 2012/0325769, and U.S. Pat. No. 6,182,845.

These prior art devices have several known drawbacks. The devices in the prior art fail to provide a cutting blade pivotally secured to the upper surface of a cap, wherein the cutting blade is movable between a stored configuration and an upright configuration. Some devices include a piercing tip extending from the surface thereof. However, the sharp edge of the piercing tip remains upright and exposed on the cap, thereby exposing a user to the risk of becoming cut or pricked by the device. Thus, the prior art devices fail to disclose a container seal cutting device that includes a movable cutting blade that can be configured in order to prevent injury.

In light of the devices disclosed in the prior art, it is submitted that the present invention substantially diverges in design elements from the prior art and consequently it is clear that there is a need in the art for an improvement to existing container seal cutting devices. In this regard the instant invention substantially fulfills these needs.

SUMMARY OF THE INVENTION

In view of the foregoing disadvantages inherent in the known types of container seal cutting devices now present in the prior art, the present invention provides a new container seal cutting device wherein the same can be utilized for providing convenience for the user when removing the seal of a container.

It is therefore an object of the present invention to provide a new and improved container seal cutting device that has all of the advantages of the prior art and none of the disadvantages.

It is another object of the present invention to provide a container seal cutting device comprising a cap having a top wall, one or more sidewalls, and an open lower end, defining an interior volume, wherein the cap is adapted to be removably secured to the mouth of a container having a protective seal thereon.

Another object of the present invention is to provide a container seal cutting device comprising a cutting blade pivotally secured to the upper surface of the top wall and adapted to puncture and cut the protective seal disposed on a container.

Yet another object of the present invention is to provide a container seal cutting device wherein the cutting blade is movable between a stored configuration, such that the cutting blade rests within a recessed area on the top wall of the cap so that it remains substantially flush with the upper surface thereof, and an upright configuration, such that the cutting blade extends substantially perpendicularly from the top wall of the cap so it can be utilized to open the seal of a container.

Yet another object of the present invention is to provide a container seal cutting device comprising a protrusion disposed on the cutting blade in order to safely move the cutting blade between the stored and upright configurations.

Another object of the present invention is to provide a container seal cutting device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
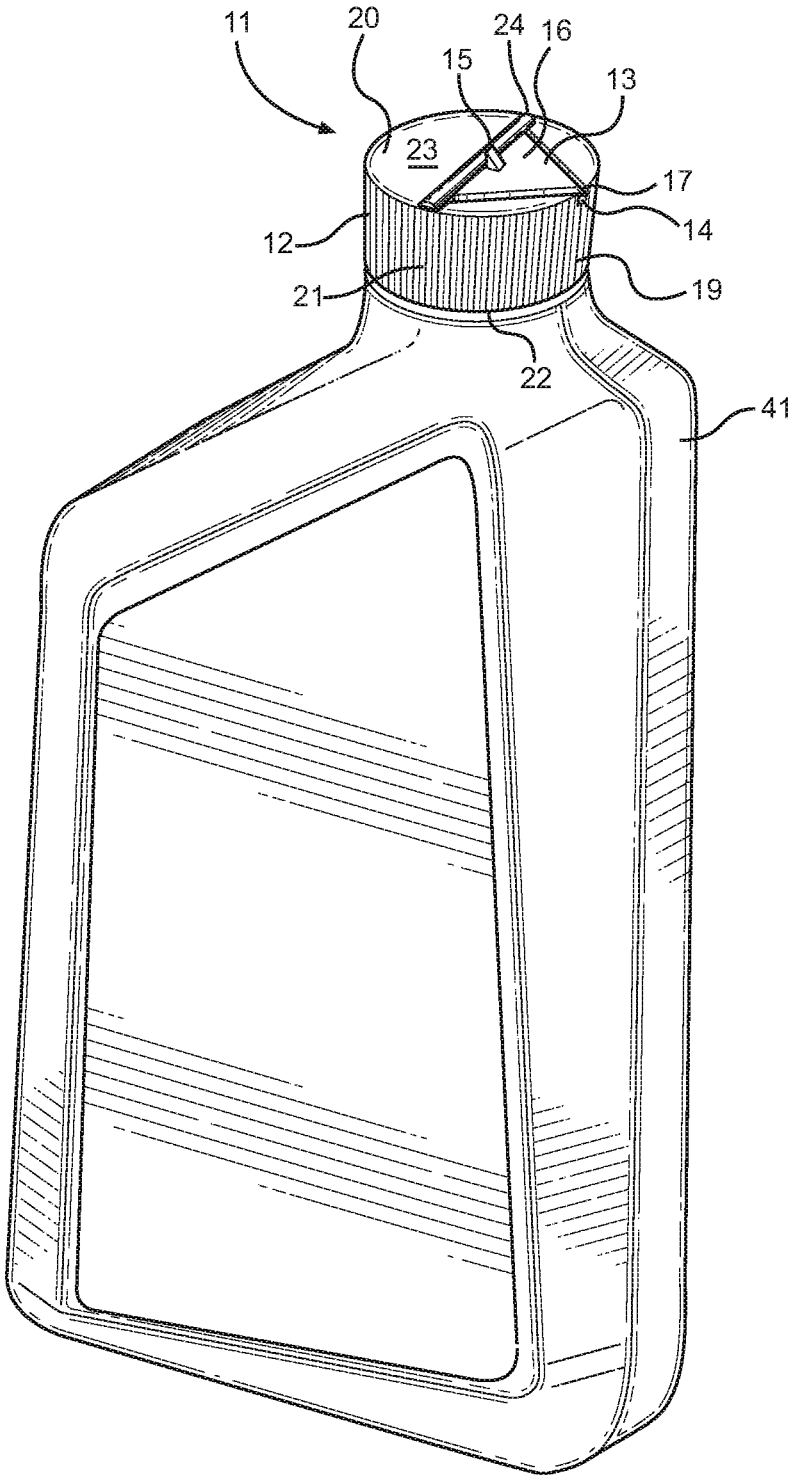
FIG. 1 shows a perspective view of an embodiment of the container seal cutting device positioned on the mouth of a container having a protective seal thereon.

Reference is made herein to the attached drawings. Like reference numerals are used throughout the drawings to depict like or similar elements of the container seal cutting device. For the purposes of presenting a brief and clear description of the present invention, the preferred embodiment will be discussed as used for puncturing and cutting a protective seal from a container. The figures are intended for representative purposes only and should not be considered to be limiting in any respect.

Figure 2:
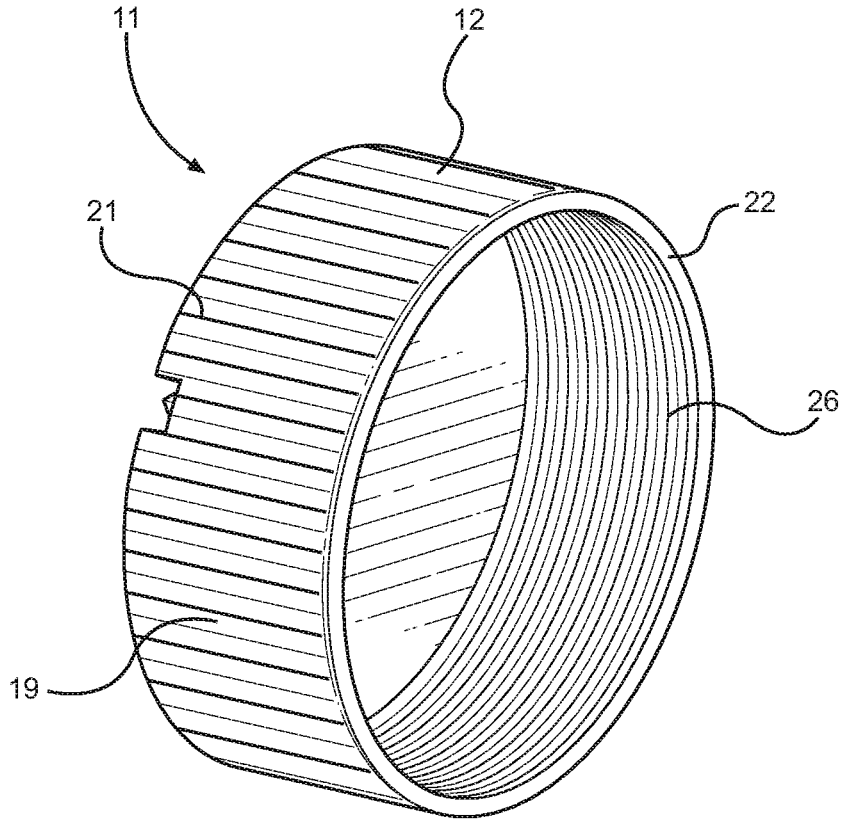
FIG. 2 shows a perspective view of the underside of the cap of the container seal cutting device.

Referring now to FIGS. 1 and 2, there is shown a perspective view of an embodiment of the container seal cutting device positioned on the mouth of a container having a protective seal thereon and a perspective view of the underside of the cap of the container seal cutting device, respectively. The container seal cutting device 11 comprises a cap 12 having a top wall 20, one or more sidewalls 21 extending perpendicularly from the top wall 20, and an open lower end 22, defining an interior volume. The lower end 22 is adapted to receive the mouth of a container 41 therein so as to allow the cap 12 to removably cover the opening of a container 41 in order to prevent material from spilling therefrom. In the illustrated embodiment, the cap 12 comprises a circular cross section, however, the cap 12 is shaped so as to correspond to the shaped of the mouth of the container 41.

The container seal cutting device 11 comprises a plurality of ridges 19 adapted to allow a user to easily grip and twist the cap 12 disposed on a container 41. The ridges 19 are vertically disposed around the sidewalls 21 of the cap 12, wherein the ridges 19 are spaced at fixed intervals. However, in other embodiments, the ridges can be replaced with any suitable configuration that provides a grip for the user, such as a pattern of straight, angled, or crossed lines. In some embodiments, the interior of the sidewalls 21 comprise threading 26 so as to allow the cap 12 to removably secure to a threaded mouth of a container 41. However, in other embodiments, the threading 26 on the interior of the sidewall 21 is omitted if the mouth of the container 41 does not comprise threading thereon.

The container seal cutting device 11 further comprises a cutting blade 13 pivotally secured to the upper surface 23 of the top wall 20 of the cap 12, wherein the cutting blade 13 is adapted to puncture and cut a protective seal (referenced in FIG. 2, 18) disposed over the mouth of the container 41. The cutting blade 13 is disposed along the diameter of the cap 12, wherein the cutting blade 13 is secured thereto via a hinge 24. Further, the cutting blade 13 is contained within the top wall 20 so as to prevent any portion of the cutting blade 13 from extending off the sides of the cap 12. Thus, preventing the cutting blade 13 from becoming exposed and unintentionally injuring a user. The cutting blade 13 comprises a triangular shape having a front side 16 and a rear side. The tip 17 and an edge of the cutting blade 13 are sharp so as to cut through the protective seal disposed on the container 41.

The cutting blade 13 is movable between a stored configuration and an upright configuration. In the stored configuration, the cutting blade 13 is positioned within a recessed area 14 on the top wall 20 of the cap 12 so that the rear side of the cutting blade 13 remains substantially flush with the upper surface 23 thereof. The recessed area 14 comprises a triangular shape that corresponds to the shape of the cutting blade 13. Thus, the edges of the recessed area 14 provide a protective barrier for the sharp edges of the cutting blade 13 in order to prevent a user from cutting himself or herself. In other embodiments, the recessed area 14 can be any suitable shape similar to that of the cutting blade 13.

The container seal cutting device 11 further comprises a protrusion 15 disposed on the cutting blade 13 so as to allow a user to safely move the cutting blade 13 between the stored and upright configurations. In the illustrated embodiment, the protrusion 15 extends perpendicularly from the front side 16 of the cutting blade 13. In other embodiments, the protrusion 15 can comprise any suitable configuration as long as it is adapted to allow the cutting blade 13 to move positions while avoiding having a user having to contact a sharp edge or tip 17 of the cutting blade 13.

Figure 3:
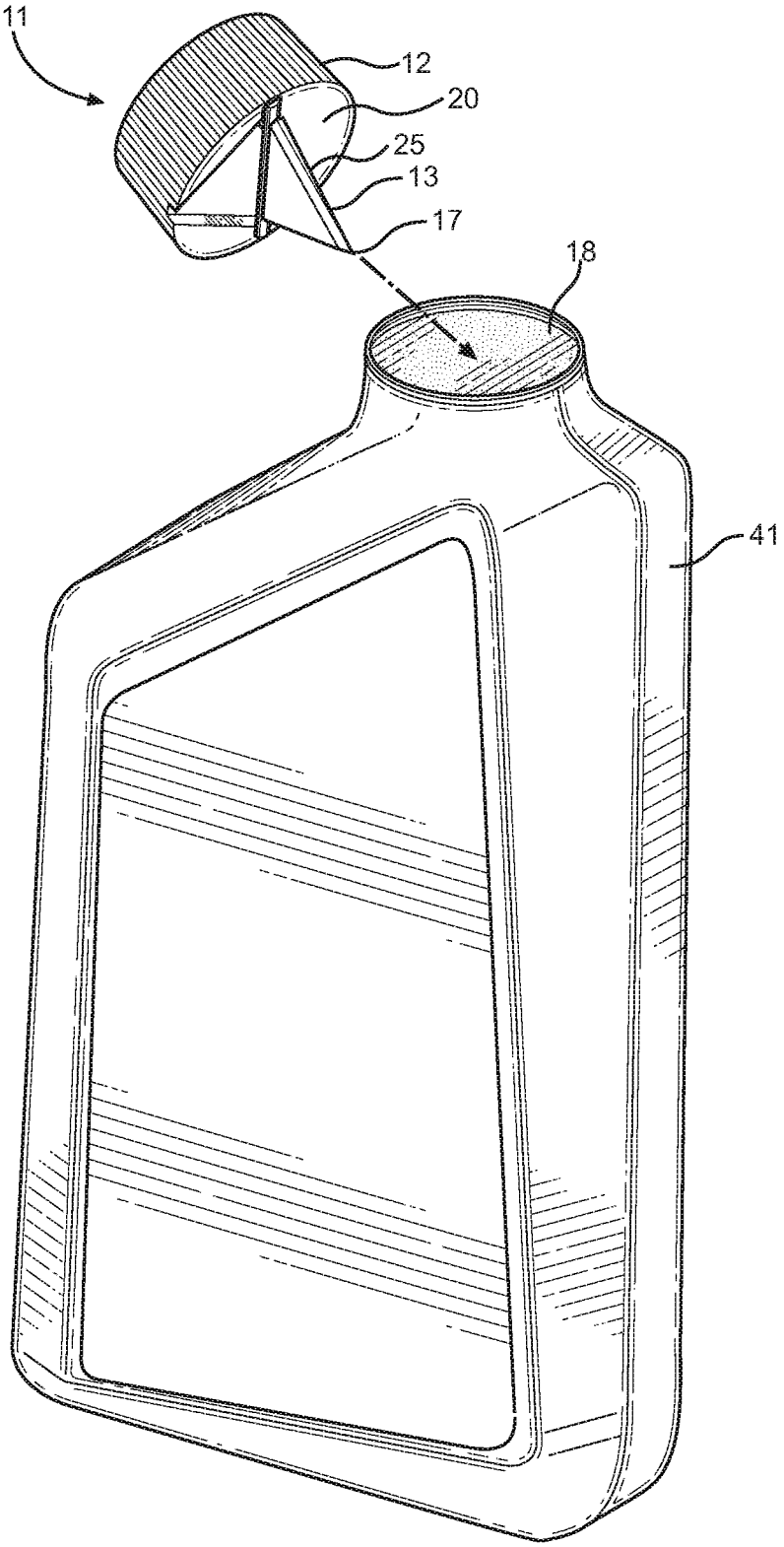
FIG. 3 shows a perspective view of an embodiment of the container seal cutting device positioned to puncture and cut the protective seal of a container.

Referring now to FIG. 3, there is shown a perspective view of an embodiment of the container seal cutting device positioned to puncture and cut the protective seal of a container. In the upright configuration, the cutting blade 13 extends substantially perpendicularly from the top wall 20 of the cap 12. In operation, the user positions the cutting blade 13 into the upright configuration by pressing and moving the protrusion 15 towards the top wall 20 of the cap 12. Once the cutting blade 13 is positioned in the upright configuration, it can be used to puncture and cut the protective seal 18 of a container 16. The cap 12 is then inverted so the cutting blade 13 is positioned for insertion into the protective seal 18. The tip 17 of the cutting blade 13 punctures the seal 18 and the sharp edge 25 is used to cut around the perimeter of seal 18. After the seal 18 has been removed, the protrusion 15 is lifted away from the top wall 20 so the cutting blade 13 can be placed in the recessed area, wherein it lays in the stored configuration.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A container seal cutting device, comprising:

a cap having a top wall, one or more sidewalls extending from said top wall, and an open lower end, defining an interior volume, wherein said open lower end is adapted to receive a mouth of a container;

a cutting blade pivotally secured to an upper surface of said top wall of said cap, wherein said cutting blade is adapted to puncture and cut a protective seal of said container;

a recessed area disposed on said upper surface of said top wall of said cap;

wherein said cutting blade is movable between a stored configuration wherein said cutting blade is positioned within said recessed area so that said cutting blade remains flush with said upper surface of said top wall, and an upright configuration wherein said cutting blade extends perpendicularly from said top wall of said cap.

2. The container seal cutting device of claim 1, wherein said cap comprises a plurality of ridges disposed on said one or more sidewalls.

3. The container seal cutting device of claim 1, wherein said cap comprises a circular cross section.

4. The container seal cutting device of claim 1, wherein said cutting blade comprises a triangular configuration.

5. The container seal cutting device of claim 4, wherein said recessed area comprises a triangular configuration corresponding to said triangular configuration of said cutting blade.

6. The container seal cutting device of claim 1, further comprising a protrusion disposed on said cutting blade, wherein said protrusion extends perpendicularly from said cutting blade.

7. The container seal cutting device of claim 1, wherein an interior of said one or more sidewalls are threaded in order to allow said cap to removably secure to a container having a threaded mouth.

8. The container seal cutting device of claim 1, wherein said cutting blade is pivotally affixed to a central portion of said top wall of said cap.

* * * * *